US006105650A

United States Patent [19]

Manusch et al.

[11] Patent Number: 6,105,650

[45] Date of Patent: Aug. 22, 2000

[54] HAND-OPERATED INSTRUMENT FOR TRANSFERRING A FILM FROM A SUPPORT SHEET TO A SUBSTRATE

[75] Inventors: Christoph Manusch, Hemmingen; Wulf Herrmannsen, Ronnenberg; Olaf Balke, Wunstorf, all of Germany

[73] Assignee: Pritt Produktionsgesellschaft mbH, Hannover, Germany

[21] Appl. No.: 09/117,743

[22] PCT Filed: Jan. 27, 1997

[86] PCT No.: PCT/EP97/00352

§ 371 Date: Feb. 24, 1999

§ 102(e) Date: Feb. 24, 1999

[87] PCT Pub. No.: WO97/29036

PCT Pub. Date: Aug. 14, 1997

[30] Foreign Application Priority Data

Feb. 5, 1996 [DE] Germany ..... 196 04 056

[51] Int. Cl.[7] ..... B32B 31/00

[52] U.S. Cl. ..... 156/540; 156/577; 156/579

[58] Field of Search ..... 156/540, 574, 156/577, 579; 118/200, 257; 15/97.1, 104.94; 400/695, 696, 700

[56] References Cited

U.S. PATENT DOCUMENTS

| | | | |
|---|---|---|---|
| 763,768 | 6/1904 | Kerns et al. | 156/574 |
| 3,889,310 | 6/1975 | Barouh et al. | 15/104.94 |
| 4,234,374 | 11/1980 | Frank | 156/574 |
| 4,671,687 | 6/1987 | Tamai | 400/695 |
| 4,853,074 | 8/1989 | Manusch et al. | 156/577 |
| 4,997,512 | 3/1991 | Manusch et al. | 156/486 |
| 5,049,229 | 9/1991 | Czech | 156/577 |
| 5,393,368 | 2/1995 | Stevens | 156/579 |
| 5,430,904 | 7/1995 | Ono et al. | 156/577 |
| 5,679,156 | 10/1997 | Matsumaru | 156/579 |
| 5,714,035 | 2/1998 | Stevens | 156/579 |
| 5,772,840 | 6/1998 | Morihaga | 156/577 |
| 5,820,728 | 10/1998 | Stevens et al. | 156/577 |
| 5,948,201 | 9/1999 | Alveskog | 156/579 |

FOREIGN PATENT DOCUMENTS

| | | |
|---|---|---|
| 0 313 719 | 5/1989 | European Pat. Off. . |
| 38 32 163 | 11/1989 | Germany . |
| 42 20 712 | 1/1994 | Germany . |

*Primary Examiner*—Steven D. Maki

*Attorney, Agent, or Firm*—Wayne C. Jaeschke; Stephen D. Harper

[57] ABSTRACT

A hand-held device for transferring a film from a carrier tape to a substrate includes an applicator with an end projecting from a housing around which the carrier tape coming from a supply roll is guided to a take-up spool and on which contact surfaces are provided for the "pull" and "push" operating modes of the device, the carrier tape being pressed against the substrate by the contact surfaces for the purpose of transferring the film. The applicator contains two application toes which are separated from one another by an empty space and each of which carries one of the two contact surfaces.

17 Claims, 2 Drawing Sheets

HAND-OPERATED INSTRUMENT FOR TRANSFERRING A FILM FROM A SUPPORT SHEET TO A SUBSTRATE

BACKGROUND OF THE INVENTION

1. Field of the Invention

This invention relates to a hand-held device for transferring a film from a carrier tape to a substrate.

2. Discussion of the Related Art

One such device is described in DE 38 32 163 A1. In this case, the applicator consists of an application foot which is provided at its free end with a thin-lipped application toe to guarantee flutter-free application of the film transversely of the longitudinal axis of the carrier tape, as required for example in the transfer of a cover-up film from the carrier tape to the substrate. The films used are mainly adhesive films or cover-up films.

The thin-lipped application toe contains the contact surface and provides for uniform pressing of the film-coated carrier tape against the substrate surface, even where the substrate is elastic and/or uneven, such as a work surface. This construction is designed in particular for application of the film to the work surface in the pull mode of operation.

Hand-held devices designed both for pulling and for pushing application of the film to the work surface are a more recent innovation. The push mode of such devices affords the advantage that, for example for delicate cover-up tasks, such as text corrections, the beginning and end of the text to be corrected are easy to see and are not covered by the device, as is the case with transfer in the pull mode.

One such hand-held device, comprises a housing from which projects a supporting foot with an applicator roller at its free end as the applicator. To transfer the film to the substrate, the film-coated carrier tape coming from a supply roll is guided to the applicator roller where it can be pressed against the substrate by a first contact surface or a second contact surface depending on how the device is held, i.e. depending on whether the device is to be operated in the pull or push mode. After the film or film layer has been transferred to the substrate, the empty tape is guided to the take-up spool.

If the two operating modes, i.e. the pull mode and the push mode, are to be employed as and when required, the applicator must be substantially symmetrical in construction because, to change the mode of operation, the hand-held device has to be turned through 180° to apply the other contact surface to the work surface formed by the substrate. Since the carrier tape, when it is being offwound from the supply roll, has to drive the supply roll, including its core and rotatable mounting, and also a slipping clutch and the take-up spool for taking up the empty tape, including its core and rotatable mounting, torques are generated which have to be overcome by the adhesion of the film to the substrate because otherwise the film will tear and/or the transport of the carrier tape will stop.

Although an applicator roll is suitable for the pull and push modes of the hand-held device, it does not guarantee flutter-free application of the film at a right-angle to the longitudinal axis of the carrier tape, as required for the transfer of a cover-up film to a substrate and as can be achieved by using an application toe as the applicator.

Tests with application toes have shown that, depending on the adhesiveness of a film, its use presupposes a minimum contact surface between the film and substrate which is determined by the width of the carrier tape and the contact length of the carrier tape on the substrate. In addition, a user must not be confined to one particular angle of application of the hand-held device in operation, instead the device should also operate reliably at angles of application selected individually within certain limits which can be achieved by making the contact area, i.e. the particular contact surface, preferably round in shape.

Accordingly, known hand-held devices for transferring a film from its carrier tape to the substrate by push or pull application have a radius of curvature of the application toe of 0.4 to 0.6 mm which leads unavoidably to a thickness of the application toes that rules out elastic adaptation to the substrate. However, since there is a lower limit to the radius of curvature, the advantages of the application toe used in the hand-held device according to DE 38 32 163 A1, including for example elastic adaptation to an uneven substrate and exact application of the film layer, cannot all be achieved in a hand-held device designed for both push and pull operation either with a known application toe or with an applicator roll.

SUMMARY OF THE INVENTION

An object of the invention is to improve the hand-held device for transferring film from a carrier to a substrate in such a way that, both in the pull mode and in the push mode, it will always ensure uniform and uninterrupted transfer of the film from the carrier tape to the substrate and also clean separation of the film at the end of its application.

In the present invention, an improved hand-held film transfer device comprises an applicator including two application toes which are separated from one another by an empty space and each of which carries one of two contact surfaces. The use of two application toes ensures exact separation of the film at substantially a right angle to the carrier tape at the end of a desired film transfer sequence and, at the same time, provides for a sufficiently large common radius of curvature or envelope circle radius for the ends of both application toes of which the arc spans the empty space so that application is readily possible in both the pull mode and the push mode. However, the application toes can also be made so thin that, through their elasticity, they guarantee uniform application of the film even to elastic or uneven substrates by leveling out any local unevenness.

Another advantage of the invention is that an application toe optimally designed to solve a specific problem can be used in both modes of operation.

In one preferred embodiment of the invention, the application toes are elastically deformable relative to one another. This further improves the operation of the hand-held device and makes it more convenient to use because the adaptability of the contact surfaces to the substrate is further improved by providing correct and uniform application of the carrier tape and hence of the film to be transferred, even to an uneven substrate, without the hand-held device having to be pressed against the substrate with great force. The user is thus able to concentrate on guiding and holding the device which contributes towards error-free use.

In one particularly inexpensive embodiment of the hand-held device according to the invention, the applicator contains an application foot which, at its free end, forms or rather terminates in the two application toes separated by a slot forming the empty space, for example in the form of an application foot slotted at its end. Accordingly, the applicators of known hand-held devices merely have to be replaced by applicators of the type described above without any need for further changes to the hand-held device or its individual components. Thus, a slotted application foot can have at least substantially the same shape and size as the unslotted feet used hitherto. In addition, the production of a slotted application foot does not entail any additional outlay and even saves on material which is an additional advantage. The application foot with its two application toes can be made in one or more parts. To this extent, the device according to the invention corresponds to any known hand-held device except for the slot in the application foot, the construction according to the invention ensuring that an application foot functionally equivalent to the prior art additionally affords the advantages of elastic adaptation to the substrate and clean separation of the film in both modes of operation. Accordingly, in a corresponding embodiment of the invention, an envelope circle radius obtained by the at least substantially constant continuation of an end curvature or of curvatures of the two load-free application toes beyond the slot corresponds to the radius of curvature of the known application foot.

In another advantageous alternative to a slotted application foot, the applicator comprises two separate application feet at the free ends of which application toes are formed. This alternative embodiment offers additional freedom in terms of design and arrangement and in the choice of material for the application feet so that further adaptation to the specific requirements of each of the two modes of operation is possible.

In addition, for the compactness and handiness of the device according to the invention, it is preferred that at least one application foot is adjustable so that the distance of its application toe(s) from the housing can be varied. In this way, the hand-held device can readily be adapted to the needs of the user and/or to the pull or push mode of operation. The overall adjustment possibilities include both the angle of application of the application toe(s) and hence the contact surfaces and the distance of the application toe(s) from the housing.

This embodiment is characterized, for example, by two application feet which are arranged symmetrically in relation to a common median plane extending parallel to the empty space (separating slot) and around the application toes of which the carrier tape is guided outside the housing. An application toe optimally designed to solve a specific problem can thus be used for each mode of operation, i.e. the pull mode or the push mode, of the hand-held device.

The possibility for adjustment in the embodiment comprising two application feet is particularly advantageous when the two application feet are coupled to one another for adjustment to enable the distances of their application toes from the housing to b oppositely adjusted. In this way, the application foot envisaged for the intended mode of operation of the hand-held device, i.e. pull or push, can be brought into the optimal operating position by extension or unfolding while the other application foot can be withdrawn or folded away, for example, so that it does not impede the film transfer process or obstruct the user's view of the work zone or transfer zone. Because the two adjusting movements are coupled, only one actuation is necessary to switch the hand-held device between the two modes of operation.

In view of the coupled, oppositely directed adjustment of two application feet, it is also of particular advantage if the coupling is designed for opposite but equal adjustment distances on both application toes, preferably as a synchronous adjustment. The same adjustment distance for both application feet ensures that the carrier tape guided over them bears reliably against the application toes or rather their contact surfaces in each of the two positions because the overall length of the path followed by the carrier tape from the supply roll to the take-up spool is constant by virtue of the synchronous adjustment, so that the carrier tape cannot become loose and slip off the application toes.

Depending on their position, the effect of two substantially parallel, fixed, i.e. non-adjustable (in relation to the housing), and above all equally long application feet can be that, in one or even both modes of operation, the user's view of an actual work zone may be obstructed by the particular foot which is inactive in the selected mode of operation. By combining the variants described above, it is possible for example to create an embodiment in which the feet are displaceable parallel to one another in such a way that the user's view of the actual work zone is never obstructed.

In the hand-held device according to the invention, the application feet or rather the application toes are preferably adjusted by a reversing mechanism which, in the simplest case, is manually operable. However, it can also be automatic, in which case it automatically assumes certain positions in dependence for example upon the handling of the device. In the case of a manually operated mechanism, the positions in question can be held, for example, by catches or locks. Where the mechanism is automatic, they may be held, for example, by clamping wedges designed to slide according to the position of the device.

The reversing mechanism can be manually operated, for example, by a rotary or rocker switch or by a slide. To enable the selected position to be readily recognized, suitable aids, for example a pointer which makes the position easier to assign to the particular aid, may be provided at corresponding positions of the switch or slide. It is even possible to make the switch or slide itself in the form of a pointer.

However, to adjust each adjustable application foot, the reversing mechanism preferably contains a crank lever which forms a crank guide for a shaped projection arranged on the associated application foot with which it is in sliding engagement. In this way, a rotary and/or sliding movement, for example of a handle or switch on the outside of the device, can be converted particularly easily into an adjusting movement for the application foot or the application feet, the exact sequence of this movement and the time it takes being determined in advance by the shape of the crank guide.

If the two crank levers act equally in opposite directions for two adjustable application feet and if, in particular, they have the same effective lengths, as is the case in another preferred embodiment of the invention, the carrier tape is always under the same tension at least in the end position of both operating modes and in particular during the adjustment of the application foot or the application feet.

In another preferred embodiment of the device according to the invention, the housing is at least substantially symmetrical in design for the pull and push modes of operation of the hand-held device, so that it may advantageously be held and guided equally easily and safely in either mode.

According to another embodiment the invention, the free end of the applicator is designed in such a way that the end faces of the two application toes with the empty space in between lie on a common envelope circle radius, preferably of 0.4 to 0.6 mm. By virtue of these preferred dimensions, it is possible to achieve empirically determined optimal dimensions of the hand-held device according to the invention for pull and push operation so that uniform offwinding of the carrier tape and reliable transfer of the film to the substrate are guaranteed in both modes of operation. The radius of the envelope circle corresponds to the radius of curvature which, in an application foot according to the prior art, has to be gauged in such a way that it ensures an adequate contact surface of the carrier tape or rather the film on the substrate at individually selectable angles of application of the hand-held device in operation.

In another advantageous embodiment of the invention, the contact surface of one application toe is designed specifically for the pull operating mode while the contact surface of the other application toe is designed specifically for the push operating mode of the hand-held device in order to optimize its operation and use.

BRIEF DESCRIPTION OF THE DRAWINGS

The invention is described by way of example in the following with reference to the accompanying drawings, in which like items are identified by the same reference designation, wherein.

DETAILED DESCRIPTION OF THE INVENTION

Figure 1:
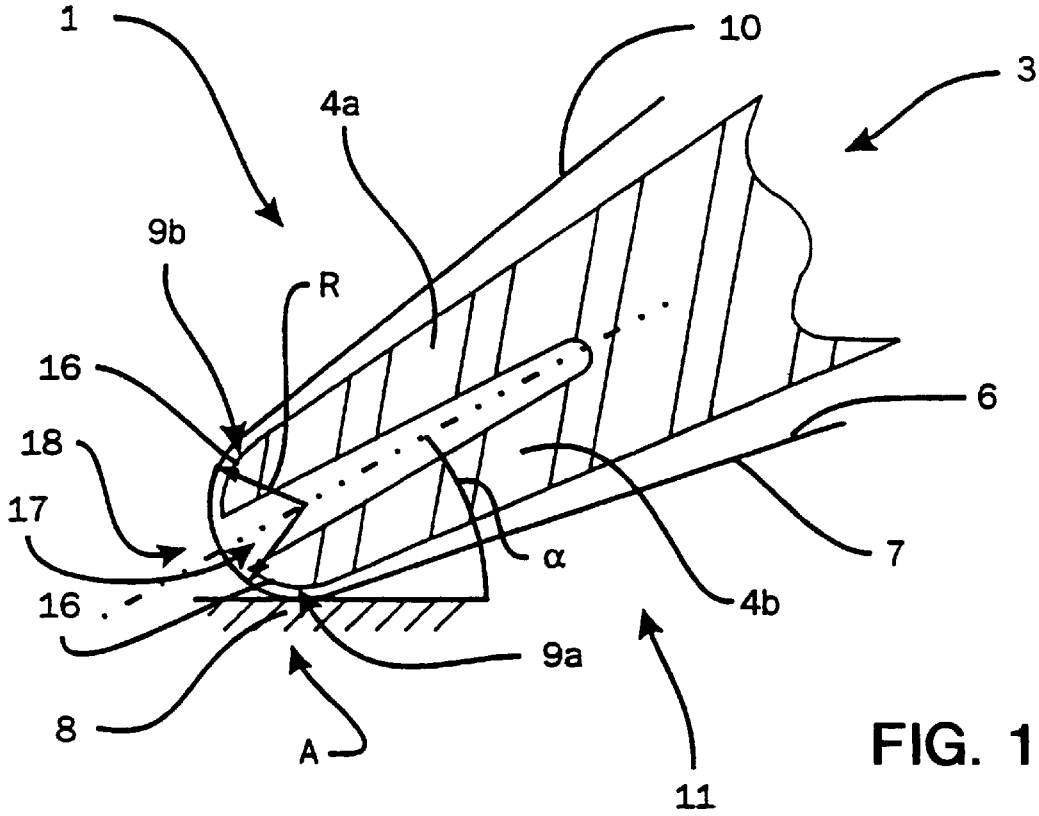
FIG. 1 is a detailed lateral view of an applicator according to a first embodiment of the hand-held device according to the invention as seen in longitudinal section.

FIG. 1 shows an applicator 1 of a hand-held device (not otherwise shown) comprising an application foot 3 at the front end 11 of which two application toes 4*a*, 4*b* separated by an empty space 18 in the form of a slot 17 are integrally formed. To transfer a film 7 from a carrier tape 6 to a substrate 8, the applicator 1 projects from a housing 2 (cf. FIG. 3) at its end 11. The carrier tape 6 coming from a supply roll (not shown) passes over the applicator 1 where it changes direction and, over its adjoining section 10, is guided to a take-up spool (not shown) in the housing 2. For the pull and push modes of operation of the hand-held device, contact surfaces 9*a* and 9*b* are provided at the front free ends of the two application toes 4*a*, 4*b* so that the carrier tape 6 can be pressed against the substrate 8 to transfer the film 7.

As shown in FIG. 1, the free ends of the two application toes 4*a*, 4*b* are rounded towards one another, i.e. their curvatures lie on a common envelope circle with a radius R of 0.4 to 0.6 mm.

In a preferred embodiment, the slot 17 is made fairly narrow so that, when the application foot 3 is pressed against the substrate 8, it cannot be so heavily deformed or narrowed at its end 11 that the carrier tape 6 is no longer sufficiently guided over the application toes 4*a*, 4*b* and can slide off laterally from the application foot 3.

The curvatures 16 enable the contact surfaces 9*a*, 9*b* to assume a position adaptable to an angle of application $\alpha$ which is promoted by the flexibility and elasticity of the application toes 4*a*, 4*b*. In this way, the hand-held device can always be conveniently held by the user and, at the same time, the film 7 can be satisfactorily transferred.

However, the two application toes 4*a*, 4*b* not only yield elastically to pressure at their thin-lipped free end, i.e. in the vicinity of the curvatures, they are also elastically deformable relative to one another in the entire vicinity of the slot 17. In this way, for example, contact pressures differing in intensity according to the user can also be equalized, the inactive application toe 4*b*, 4*a*acting as a stop for the other application toe 4*a* or 4*b* bent by the pressure applied. A separate stop (not shown) may optionally be provided for application feet in other embodiments of the invention.

The hand-held device is provided with an at least substantially symmetrical housing 2 so that it lies in substantially the same position in the user's hand both in the pull mode and in the push mode of operation. In order to be able to switch between the two modes of operation, the hand-held device held, for example, in the user's right hand for the pull mode can be transferred to the left hand without any change in its spatial position or orientation, after which it is turned anticlockwise until it is aligned in such a way that film can now be transferred with the left hand in the push mode in which the contact surface 4*b* and no longer the contact surface 4*a* is used to press the carrier tape 6 against the substrate 8. To this end, the application foot 3, like the housing 2, is substantially symmetrical in construction.

By virtue of the curvatures 16, the hand-held device is shaped in such a way in the vicinity of the contact surfaces that one application toe 4*a* is particularly adapted to the pull mode while the other application toe 4*b* is particularly adapted to the push mode of operation. The use of the application toes 4*a* and 4*b* as opposed to an applicator roller provides for exact separation of the film 7 transversely of the direction of travel of the carrier tape at the end of the film transfer path. The application toes 4*a*, 4*b* can be made so thin that they always ensure uniform application, even to an uneven substrate 8.

Figure 2:
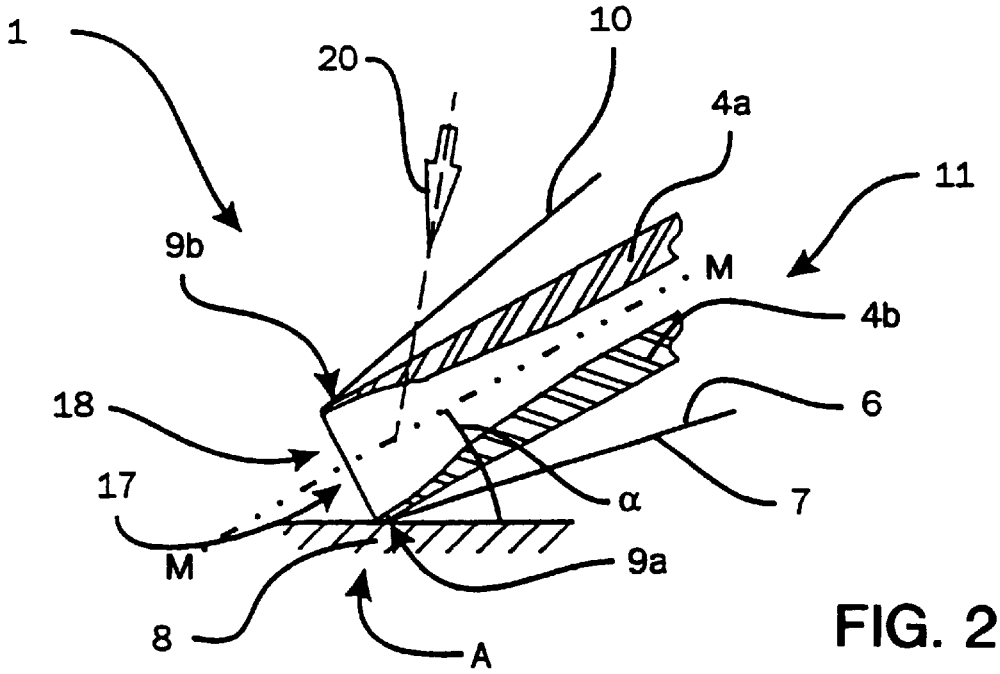
FIG. 2 is a detailed lateral view of an applicator according to a second embodiment of the hand-held device according to the invention as seen in longitudinal section.
Figure 3:
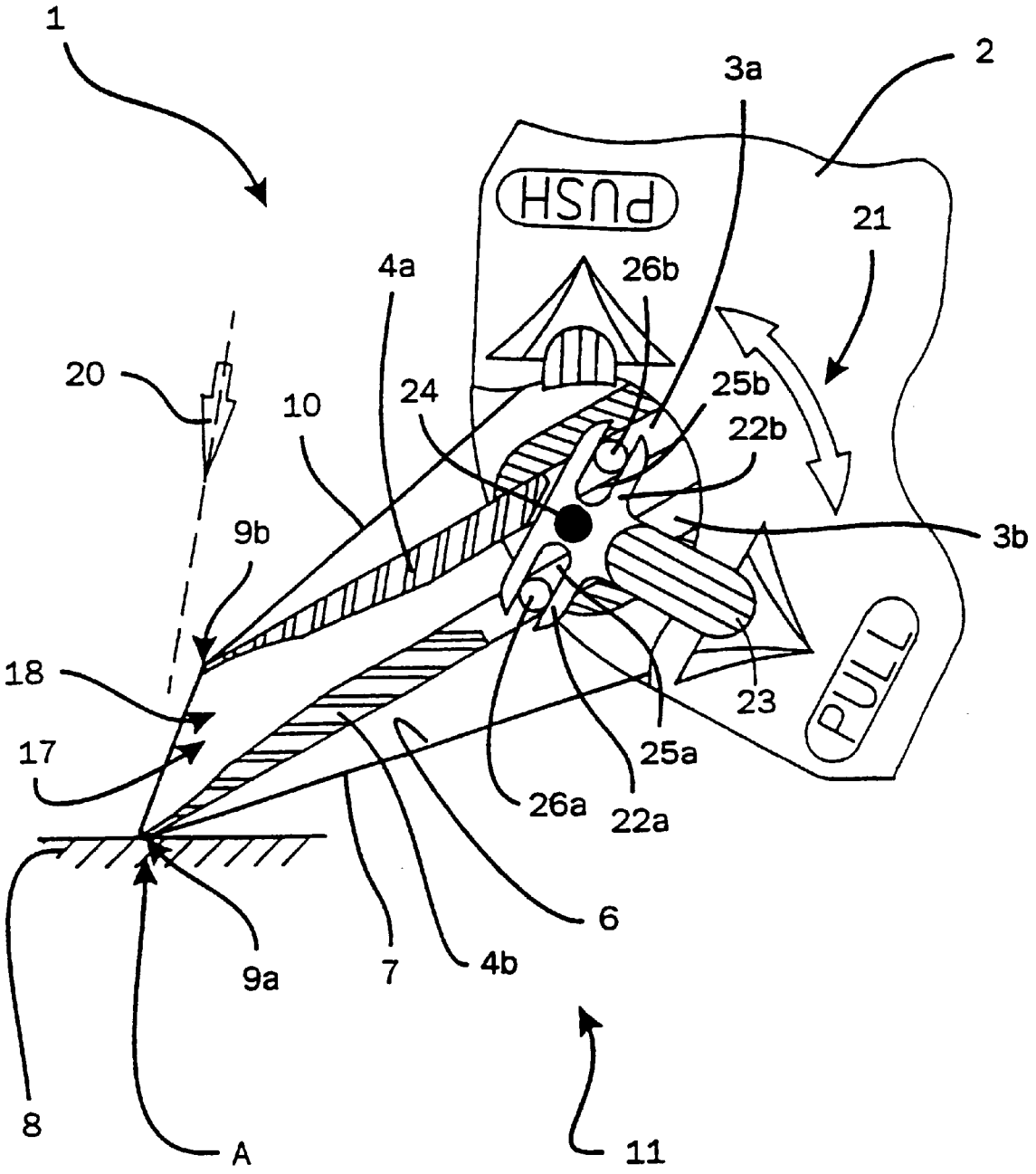
FIG. 3 is an extended detailed lateral view of the embodiment according to FIG. 2 as seen in longitudinal section.

Details of another embodiment of an applicator 1 are shown in FIGS. 2 and 3.

FIG. 2 shows the front part 11 of an applicator 1 comprising two application feet 3*a* and 3*b* separated by an empty space 18, for example in the form of a slot 17, in the direction of transport of the carrier tape 6. Each of the two application feet 3*a*, 3*b* terminates in an application toe 4*a*, 4*b*. Provided once again on the application toes 4*a*, 4*b* are contact surfaces 9*a*, 9*b* by means of which the carrier tape 6 can be pressed against the substrate 8 for film transfer. The application toes 4*a*, 4*b* themselves are flexible to the extent that they are able to level out any unevenness in the substrate 8. To this end, the application toes 4*a*, 4*b* are thin-lipped which, as shown in FIGS. 2 and 3, is achieved by tapering the longitudinal cross-section of the application toes 4*a*, 4*b* in the direction of the carrier tape so that the empty space 18 becomes larger towards the end of the application toes 4*a*, 4*b*. However, this construction is merely intended as an example because the necessary flexibility of the application toes can also be achieved by other design measures or by other choices and combinations of the constituent material. In particular, the integral construction of the application feet 3*a*, 3*b* with the application toes 4*a*, 4*b* may be replaced by a non-integral construction.

The two application toes 4*a*, 4*b* form part of the application feet 3*a*, 3*b* and are elastically deformable relative to one another. This creates another displacement or equalization path which is capable of absorbing various contact pressures applied to the substrate 8 so that the correspondingly equipped hand-held device can always perform optimally in use irrespective of the strength of the user.

The two application feet 3*a*, 3*b* are arranged symmetrically to the middle axis M—M of the gap 17 and each carry an application toe 4*a*, 4*b* optimally designed to solve a specific problem for one of the two modes of operation, i.e. the pull or push mode. The quasi-modular construction of the applicator 1 of two separate application feet 3*a*, 3*b* affords more possibilities for adaptation than just one application foot (FIG. 1) and, in addition, possibilities for adjustment, as explained in the following.

In contrast to the embodiment illustrated in FIG. 1, the application feet 3*a*, 3*b* in FIGS. 2 and 3 do not have any curvatures designed for different angles of application α of the hand-held device at the ends of their application toes 4*a*, 4*b*. Instead, the application toes 4*a*, 4*b* are made so thin at their ends that they are able to bend easily under the pressure applied in any event to the substrate 8 in use so that a broad range of angles of application α of the hand-held device relative to the substrate 8 is also possible. Depending on the actual construction of the application toes 4*a*, 4*b*, the particular contact surface 9*a*, 9*b* used may even have a larger area than in the case of FIG. 1 where—if the substrate is hard—the curvatures 16 only form a line of contact transversely of the direction of transport of the carrier tape although, basically, this is sufficient for satisfactory operation of the hand-held device.

The above-mentioned deformation which the application toes 4*a*, 4*b* undergo when the hand-held device is pressed against the substrate 8 also results in the development of a curvature although it does not have to be as uniform as the curvature 16 in FIG. 1.

FIG. 3 shows an embodiment for the arrangement as a whole in which the application feet 3*a*, 3*b* are adjustable in the distance separating the end of the associated application toe 4*a* or 4*b* from the housing 2. The adjustment of the distances between the application toes 4*a*, 4*b* and the housing 2 is coupled and oppositely directed. Accordingly, if for example the distance separating one application foot 4*a* from the housing is increased, the distance between the other application toe 4*b* and the housing 2 thus decreases automatically and preferably in synchronism.

Two operating positions can thus be adjusted to establish the pull mode or the push mode of operation, the user's view of the work zone A, for example a text correction, always being unobstructed. In each of these two operating positions, one of the application feet 3*a*, 3*b* projects further from the housing 2 than the other application foot 3*b* or 3*a*.

A comparison of FIGS. 2 and 3 illustrates this effect. In FIG. 2, the user's line of vision is indicated by an arrow 20. It can be seen that the application toe 4*b* lying above the application toe 4*a* obstructs the user's view of the work zone A. To be able to see the work zone A, the user would have to look at an angle from the left under the application toe 4*b*, based on the illustration in FIG. 2. Keeping the head in the necessary position would be tiring and would impair the ability of the user to concentrate. In addition, the work zone A covered by the application toe 4*b* would not be in the best light so that handling as a whole would be difficult.

By contrast, the adjustability of the application toes 4*a*, 4*b* shown in FIG. 3 allows an unobstructed view and provides for the optimal incidence of light in the work zone A. In the position illustrated, the application foot 3*b* with the application toe 4*b* is pushed slightly into the housing 2 so that the application toe 4*a* and, in particular, its free terminal edge is no longer covered by the application foot 3*b* and the line of sight—indicated by the arrow 20—to the boundary line between the substrate 8 and the application toe 4*a* is unobstructed.

Although not absolutely essential, the exposure of the work zone to enable the user to see is supported by the fact that, when the application toe 4*b* is pushed inwards relative to the housing 2, the application toe 4*a* is pushed out relative thereto. The two toes 4*a*, 4*b* and hence the two application feet 3*a*, 3*b* are displaced parallel to one another. By virtue of this control of the application feet 3*a*, 3*b*, the adjustment paths need only be relatively short to obtain a clear view of the work zone A in either mode of operation. Accordingly, there is no need to maintain a large space in the housing 2 to accommodate a retracted application foot 3*a* or 3*b*. However, a clear view of the work zone A could also be obtained if only one application foot 3*a* or 3*b* were displaceable into and out of the housing 2 relative to the other application foot 3*b* or 3*a*. In that case, however, the housing 2 would have to offer a slightly longer adjustment path for the adjustable application foot.

Instead of the parallel displacement of the two application feet 3*a*, 3*b* relative to one another, a corresponding adjustment could also be achieved by rotation of one application foot 3, 3*a* or 3*b* or both application feet 3*a*, 3*b*. Possibilities for the adjustment and—basically—the displacement of both application feet 3*a*, 3*b* may either be coupled or separated. Displacement and rotation could also be combined in any way with the sole proviso that, above all in the push mode of operation, which is particularly suitable for exact positioning and guiding of the hand-held device 1, the user has an unobstructed view of the work zone A.

The arrangement shown in FIG. 3 comprises a reversing mechanism 21 which contains a crank lever 22*a*, 22*b* for the adjustment of each application foot 3*a*, 3*b*. The two crank levers 22*a*, 22*b* are integrally connected to a switch 23 and mounted to pivot about a pin 24 positioned centrally between the two crank levers 22*a*, 22*b* which, in turn, extend perpendicularly of the shift lever 23 of the switch.

The two crank levers 22*a*, 22*b*, which are aligned to form mirror images of one another, are otherwise identical. Accordingly, they act oppositely with equal effect when the switch 23 is turned about the pin 24, i.e. the two application feet 3*a*, 3*b* are displaced equal distances, but in opposite directions, by actuation of the switch 23. Accordingly, reversal of the switch 23 leads to the simultaneous, automatic and synchronous withdrawal of one application foot 3*a* or 3*b* and extension of the other application foot 3*b* or 3*a* by the same distance In this way, the carrier tape 6 remains under the same tension both during tie reversal process and in both end positions which correspond to the two modes of operation.

Each crank lever 22*a*, 22*b* contains a crank slot 25*a*, 25*b* extending longitudinally thereof. Each of the application feet 3*a*, 3*b* is formed with a stud 26*a*, 26*b* which engages in the associated crank slot 25*a*, 25*b* from the side. Because the switch 23 is a rotary switch, rotary movements of the switch 23 are converted into displacements of the application feet 3*a*, 3*b*. By actuating the switch 23, the two crank levers 22*a*, 22*b* are turned oppositely about the common pivot pin 24 and entrain the corresponding studs 26*a*, 26*b* via the crank slots 25*a*, 25*b* which, in turn, results in the opposite but equidistant parallel displacement of the application feet 3*a*, 3*b*.

The switch 23 is in the form of a pointer and, in each of its end positions, is aligned with an arrow applied to the housing which points to a word—similarly applied to the surface of the housing—indicating the mode of operation selected. In the illustrated embodiment, the words PULL and PUSH indicating the mode of operation and also the arrows are applied to the surface of the housing. Accordingly, a user about to employ the hand-held device can easily tell which particular mode of operation is adjusted so that there is no danger of a hand-held device 1 adjusted for the push mode being operated in the pull mode.

In the drawings, the contact surfaces 4*a*, 4*b* are shown as identical although this is not essential. For example, the contact surface 4*a* or 4*b* of one application toe 3*a* or 3*b* may be adapted for the pull mode of operation while the contact surface 4*b* or 4*a* of the other application toe 3*a* or 3*b* may be adapted for the push mode of operation of the hand-held device.

Although various embodiments of the invention have been shown and described, they are not meant to be limiting. Those of skill in the art may recognize certain modifications, which modifications are meant to be covered by the spirit and scope of the appended claims.

What is claimed is:

1. A hand-held device for transferring a film from a carrier tape to a substrate, comprising an applicator with an end projecting from a housing around which the carrier tape coming from a supply roll is guided to a take-up spool and on which two contact surfaces are provided for pull and push operating modes of the device, the carrier tape being designed to be pressed against the substrate by said contact surfaces for the purpose of transferring the film wherein the applicator includes two vertically adjacent application toes which are separated from one another by a gap and each of which carries one of said two contact surfaces, and wherein the gap has a middle axis and the two vertically adjacent toes are arranged symmetrically to the middle axis of the gap.

2. A hand-held device as claimed in claim 1, wherein the application toes are elastically deformable relative to one another.

3. A hand-held device as claimed in claim 2, wherein the applicator comprises two separate application feet, wherein at a free end of each application foot a respective toe is formed.

4. A hand-held device as claimed in claim 2, wherein the ends of the two application toes with the empty space in between lie on a common envelope circle with a radius of 0.4 to 0.6 mm.

5. A hand-held device as claimed in claim 1, wherein the applicator includes an application foot which, at its free end, terminates in the two application toes.

6. A hand-held device as claimed in claim 5, wherein the ends of the two application toes with the empty space in between lie on a common envelope circle with a radius of 0.4 to 0.6 mm.

7. A hand-held device as claimed in claim 1, wherein the applicator comprises two separate application feet, wherein at a free end of each application foot a respective toe is formed.

8. A hand-held device as claimed in claim 7, wherein the relative position of the ends of the application toes of at least one of the application feet from the housing is adjustable.

9. A hand-held device as claimed in claim 8, further including a rotatable reversing mechanism for adjusting the free ends of the application feet.

10. A hand-held device as claimed in claim 7, wherein the two application feet are coupled to one another for adjustment to enable the distances of the application toes from the housing to be oppositely adjusted.

11. A hand-held device as claimed in claim 10, wherein the coupling is designed for opposite but equal adjustment distances.

12. A hand-held device as claimed in claim 11, further including a rotatable reversing mechanism for adjusting the free ends of the application feet.

13. A hand-held device as claimed in claim 10, further including a rotatable reversing mechanism for adjusting the free ends of the application feet.

14. A hand-held device as claimed in claim 7, wherein the relative position of the ends of the application toes from the housing is adjustable.

15. A hand-held device as claimed in claim 1, wherein the ends of the two application toes with the empty space in between lie on a common envelope circle with a radius of 0.4 to 0.6 mm.

16. A hand-held device for transferring a film from a carrier tape to a substrate, comprising an applicator with an end projecting from a housing around which the carrier tape coming from a supply roll is guided to a take-up spool and on which two contact surfaces are provided for pull and push operating modes of the device, the carrier tape being designed to be pressed against the substrate by said contact surfaces for the purpose of transferring the film, wherein the applicator includes two vertically adjacent application toes which are separated from one another by a gap and each of which carries one of two contact surfaces, wherein the applicator comprises two separate application feet, wherein at a free end of each application foot a respective toe is formed, wherein the relative position of the ends of the application toes of at least one of the application feet from the housing is adjustable, further including a rotatable reversing mechanism for adjusting the free ends of the application feet, and wherein for adjusting each of the application feet, the reversing mechanism comprises a crank lever arranged on the associated application foot.

17. A hand-held device as claimed in claim 16, wherein the reversing mechanism comprises two crank levers operating equally in opposite directions.

* * * * *